US005706535A

United States Patent [19]

Takashima

[11] Patent Number: 5,706,535

[45] Date of Patent: Jan. 13, 1998

[54] BEDDING ARTICLES WITH POCKETS CONTAINING DEODORIZER ELEMENTS

[75] Inventor: Yoshie Takashima, Takatsuki, Japan

[73] Assignee: Takashima Co., Ltd., Osaka-fu, Japan

[21] Appl. No.: 490,394

[22] Filed: Jun. 14, 1995

[30] Foreign Application Priority Data

| | | | |
|---|---|---|---|
| Jun. 14, 1994 | [JP] | Japan | 6-155156 |
| Oct. 11, 1994 | [JP] | Japan | 6-271693 |
| Dec. 20, 1994 | [JP] | Japan | 6-335007 |

[51] Int. Cl.[6] ..... A47G 9/02; A47G 9/04; A47G 9/00

[52] U.S. Cl. ..... 5/485; 5/502; 5/641

[58] Field of Search ..... 5/485, 502, 500, 5/482, 487, 694, 641, 948; 604/367

[56] References Cited

U.S. PATENT DOCUMENTS

| | | | |
|---|---|---|---|
| 2,596,547 | 5/1952 | Gurst | 5/485 |
| 3,638,255 | 2/1972 | Sterrett | 5/653 |
| 4,005,499 | 2/1977 | Klein | 5/485 |
| 5,092,008 | 3/1992 | Okubo | 5/484 |
| 5,168,590 | 12/1992 | O'Sullivan | 5/485 |
| 5,299,335 | 4/1994 | Ivester et al. | 5/641 |

FOREIGN PATENT DOCUMENTS

| | | | |
|---|---|---|---|
| 497320 | 11/1953 | Canada | 5/502 |
| 800 989 | 7/1949 | Germany | 5/502 |
| 23 38 167 | 2/1975 | Germany . | |
| 3333270 | 11/1984 | Germany | 5/502 |
| 6-327725 | 11/1994 | Japan . | |
| 658177 | 10/1986 | Switzerland | 5/502 |
| 2 184 009 | 5/1986 | United Kingdom | 5/641 |

*Primary Examiner*—Alexander Grosz
*Attorney, Agent, or Firm*—Lowe, Price, LeBlanc & Becker

[57] ABSTRACT

A bedding element having a mat body (1) made of cloth, to provide an excellent deodorizing and hygroscopic effect and a long-lasting refreshing sensation, has several deodorizer-containing pockets (2) provided on one side of the mat body, with deodorizer elements (3) respectively placed securely in each pocket (2).

15 Claims, 4 Drawing Sheets

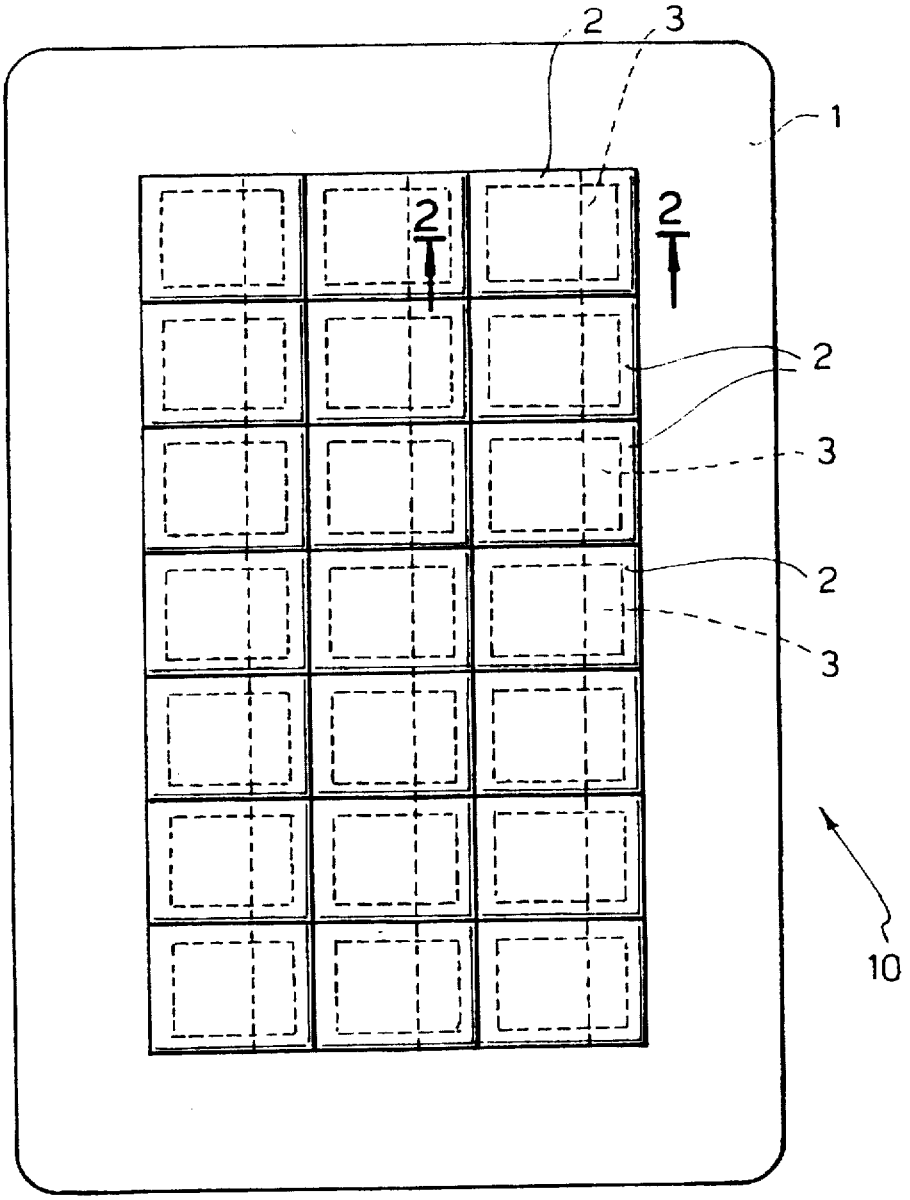
FIG. 1
FIG. 2
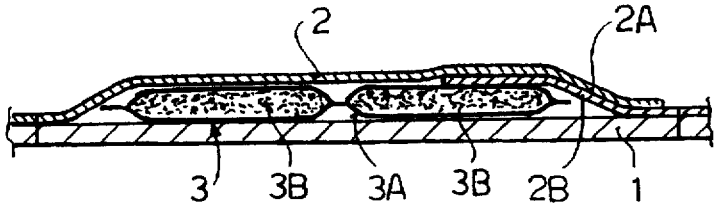
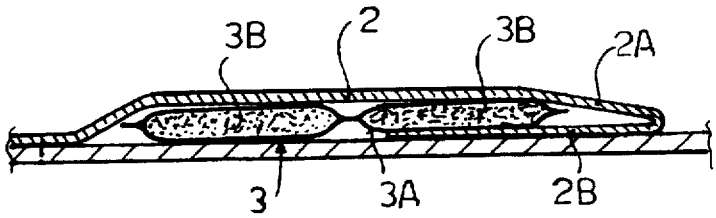
FIG. 4

FIG. 3
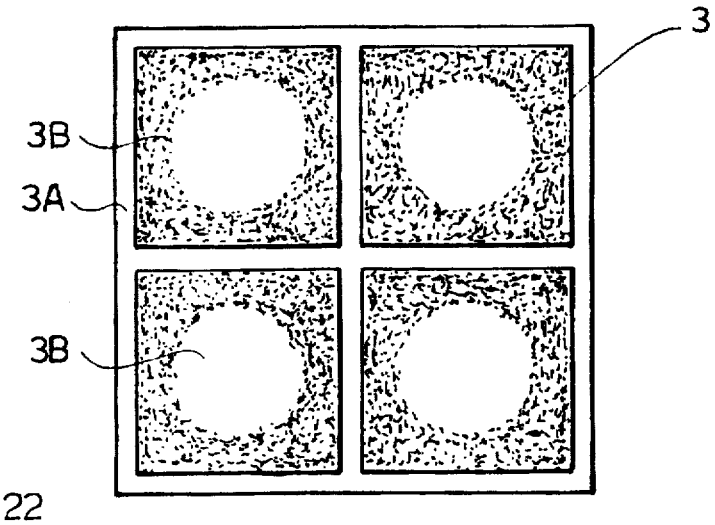
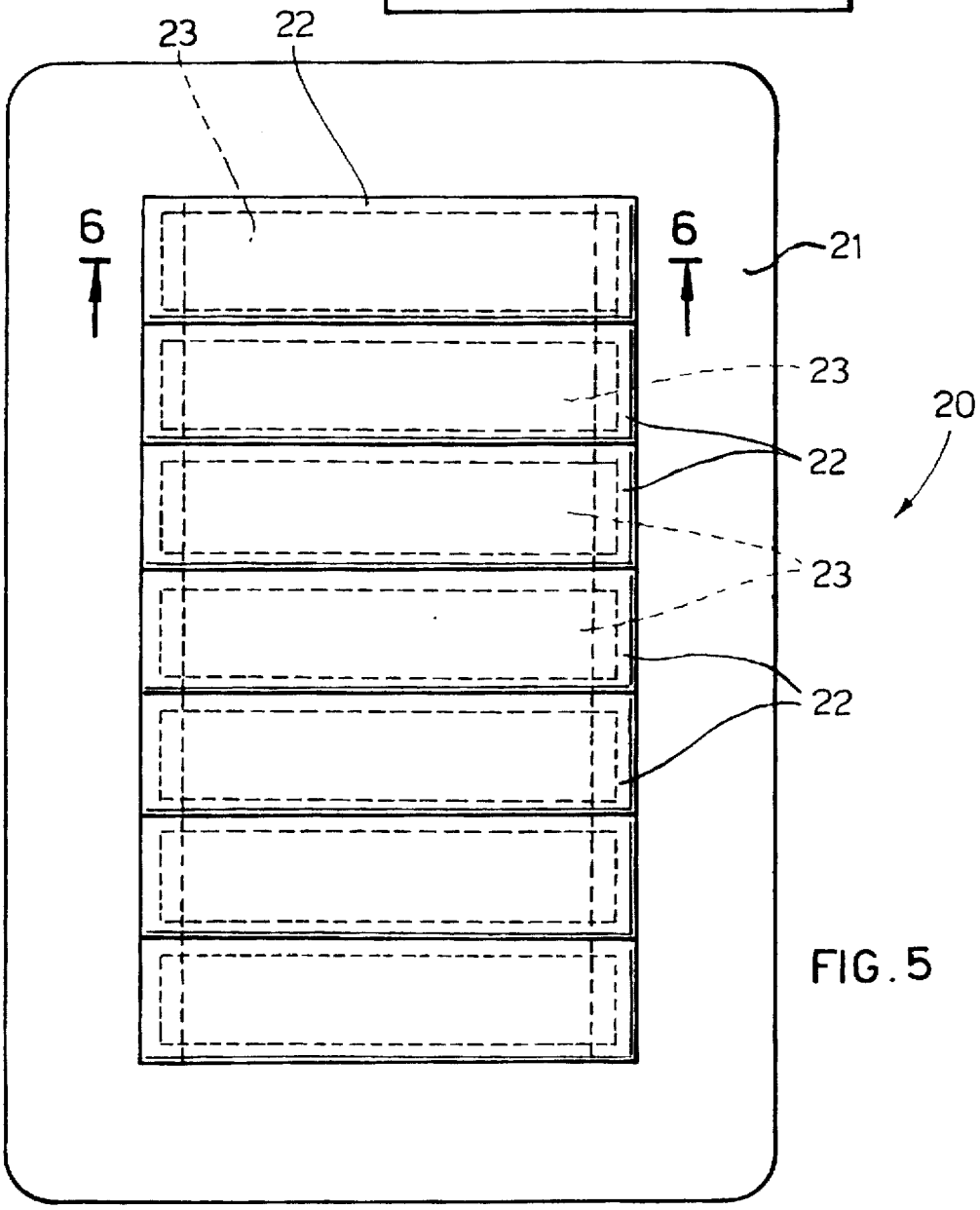
FIG. 5

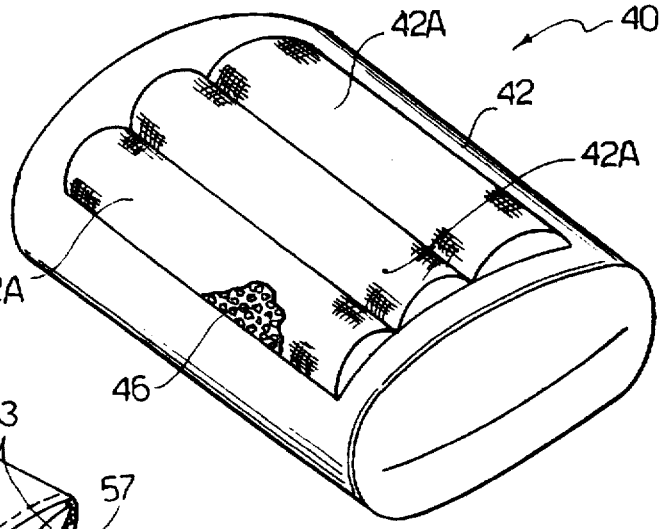
FIG. 9
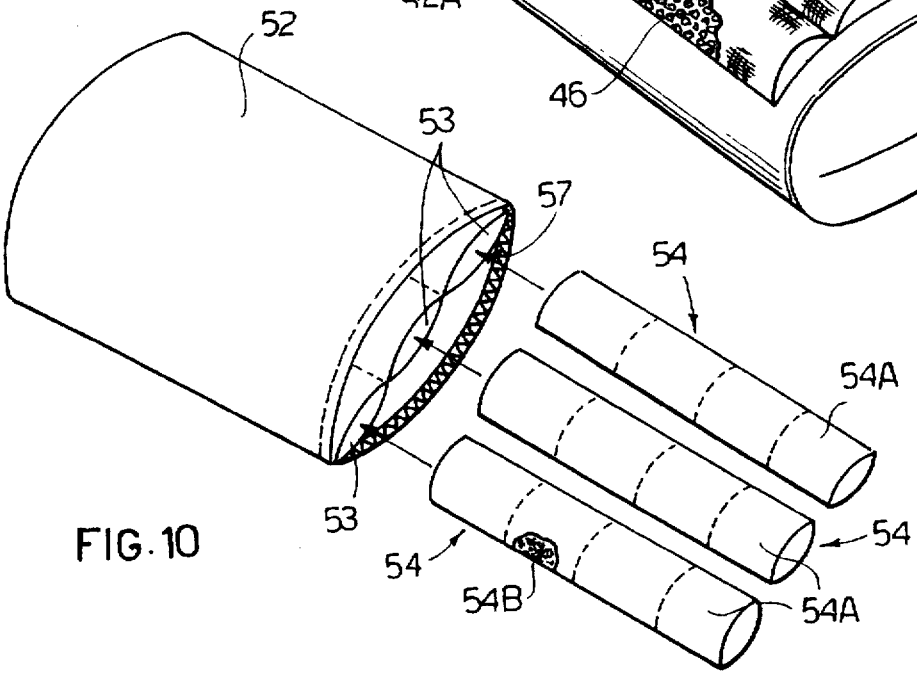
FIG. 10
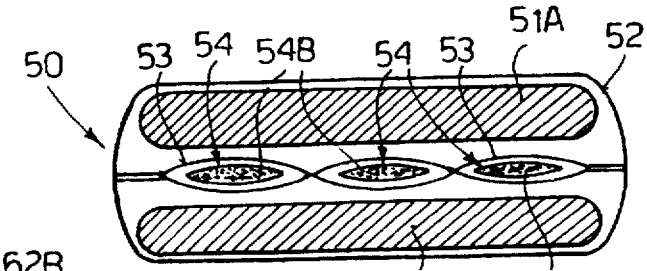
FIG. 11
FIG. 12
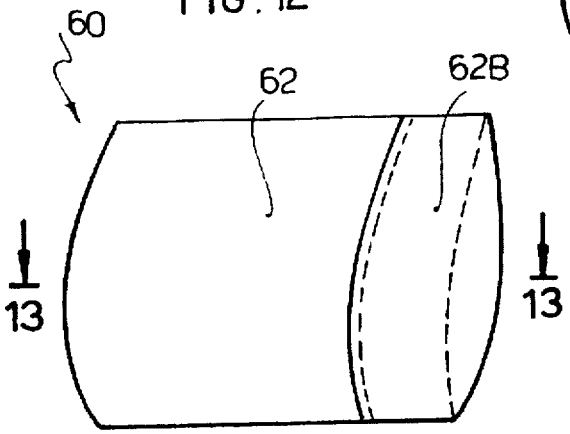
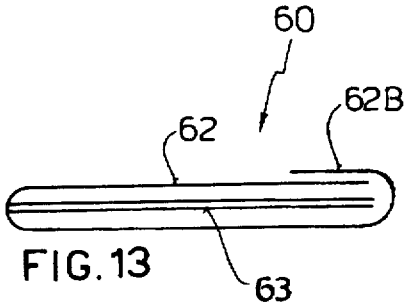
FIG. 13

BEDDING ARTICLES WITH POCKETS CONTAINING DEODORIZER ELEMENTS

FIELD OF THE INVENTION

The invention concerns bedding articles, particularly bedding mats and pillows, which provide the user deodorant and hygroscopic effects and a long-lasting refreshing feeling.

BACKGROUND OF THE RELATED ART

Traditional mats for bedding are typically spread on a cotton Futon (traditional Japanese mattress) or a conventional mattress, and are generally made of quilted cloth. However, the traditional mat when used as bedding quickly loses its sensation of freshness because it easily absorbs body odors and moisture. This is a serious problem, especially for bedridden elderly people and hospital patients.

Also widely known are pillows consisting of a cover and a pillow stuffing core made of feathers, ester cotton, buckwheat husks, polyester straws, and the like. The traditional pillow for use with bedding, however, quickly loses its sensation of freshness because the stuffing easily absorbs odors and moisture. This problem can be solved by washing the whole pillow, but while the pillow cover is easily washed, the stuffing material is often hard to clean. This is a big problem for bedridden elderly people and hospital patients. Therefore, there exists a need for a pillow that maintains its freshness without requiring washing of the stuffing material.

SUMMARY OF THE INVENTION

Accordingly, a principal object of this invention is to create a bedding article that possesses deodorizing and hygroscopic qualities and provides the user a long-lasting sense of freshness.

The invention in a preferred embodiment provides a bedding mat comprising a mat body made of cloth, and a number of pockets provided on one side of the mat body, with the pockets containing deodorizers/deodorizer elements.

In another aspect of this invention the above-mentioned deodorizer consists of a breathable bag (i.e., one allowing air and similar gaseous materials to pass through), with active carbon granules inserted in the bag.

In yet another aspect of this invention each of the above-mentioned pockets consists of a cloth pouch having an opening for the deodorizer on one side and is sewn to one side of the mat body, the pouches being arranged in a grid pattern, the cloth of the opening of the pouches being overlapped or tucked into the pouch so that the deodorizer cannot escape.

In a further aspect of this invention each of the above-mentioned pockets consists of a cloth pouch having openings for the deodorizer on both sides thereof and is sewn to one side of the mat body, the pouches being arranged along the width of the mat body, and the cloth of the opening part of each pouch being tucked into the pouch in order that the deodorizer does not escape.

The invention in a further aspect provides a pillow, for bedding, which has a stuffing core and a pillow cover with a pocket formed on at least one of the two sides of the pillow cover, the deodorizer being easily inserted and removed into the pocket.

Another version of the pillow according to the invention has a stuffing core and a pillow cover with pockets formed on both the upper and lower sides of the pillow cover, in which the deodorizer is easily inserted and removed in one side and Japanese cypress chips are inserted in the other side.

A further embodiment of the invention is a pillow, for bedding, in which the stuffing core consists of an upper stuffing core and a lower stuffing core, with a deodorizer element tucked between the layers of stuffing. A preferred deodorizer element consists of a breathable bag containing charcoal or active carbon granules.

The bedding articles according to the invention provide an excellent deodorizing and hygroscopic effect that prolongs the feeling of freshness. By overlapping the cloth of the opening of the pocket to store the deodorizer provided in the mat body, or by tucking it into the above-mentioned bag, the deodorizer will not escape from the pocket even if the mat is turned or overturned.

Moreover, when Japanese cypress chips are tucked in the pocket, e.g., of a pillow, the fragrance of the chips is constantly released in the air and favors restful sleep.

BRIEF DESCRIPTION OF THE DRAWING

FIG. 1 is a top plan view showing a first embodiment of bedding article of this invention, i.e., a bedding mat;

FIG. 2 is a cross-section view along line 2—2 of FIG. 1;

FIG. 3 is a plan view of a deodorizer element which is furnished with the bedding mat of the invention;

FIG. 4 is a cross-section view showing another example of bedding mat;

FIG. 5 is a top plan view of a further embodiment of bedding article;

FIG. 9 is a perspective view of another bedding pillow;

FIG. 10 is an exploded perspective view of another bedding pillow;

FIG. 11 is a cross-sectional view of the pillow of FIG. 10;

FIG. 12 is a perspective view of a closing element of a pillow cover; and

FIG. 13 is a cross-sectional view along line 13—13 in FIG. 12.

In the drawings, like reference numbers refer to the same or similar elements throughout.

DETAILED DESCRIPTION OF THE PREFERRED EMBODIMENTS

Figure 6:
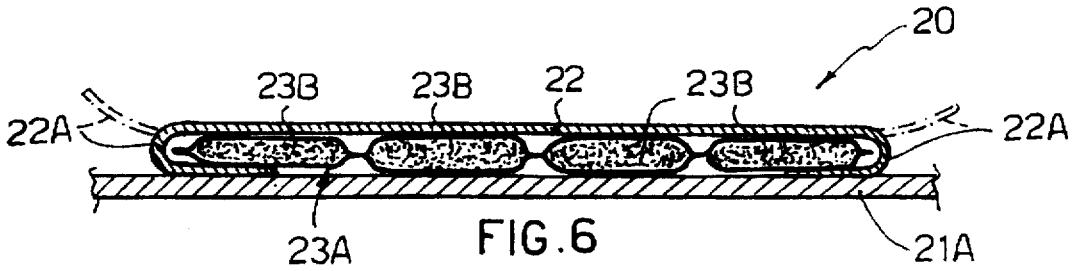
FIG. 6 is a cross-sectional view along line 6—6 in FIG. 5.

In FIGS. 1–3 a bedding article according to a preferred embodiment of the invention is a bedding mat 10 which comprises a mat body 1 made of cloth, with several pickets 2 (21 in the illustrated example) to store the deodorizer provided on one side of the mat body 1. A deodorizer element 3 is stored inside each pocket 2.

The deodorizer element 3 preferably consists of a bag 3A made of a "breathable" paper (i.e., a paper or paper-like material allowing air or similar gaseous material to pass through it) or fiber and active carbon granules 3B contained in the bag 3A, as shown in FIG. 2. Of course, another material may be used instead of active carbon granules— such as charcoal granules the like—as long as it has deodorizing and hygroscopic properties. The bag 3A is divided into several sections (four sections in the example shown in FIG. 3), to prevent the active carbon granules 3B from being unevenly distributed inside the bag 3A.

The pocket 2 consists of a cloth bag or pouch for the deodorizer element 3 that has an opening at an edge of it, the bag or pouch being sewn on one side of the mat body 1.

The above-mentioned pouches are preferably arranged in grid patterns, and cloth portions 2A and 2B of the above-mentioned opening part are overlapped to prevent the deodorizer element 3 from falling out or escaping from pocket 2 when the mat body 1 is moved in various directions or is turned over.

When the deodorizing effect decreases over time and use of the mat, its deodorizing and hygroscopic properties can be renewed by taking the deodorizer element 3 out of the pocket 2 and washing and drying it, because the deodorizer element 3 can be easily inserted and removed from the pocket. On the other hand, the mat body 1 can also be washed separately from the deodorizer 3, which is especially convenient for the user.

The cloth 2A part of the opening part of the pocket 2 may be tucked into the above-mentioned pouch, as best seen in FIG. 4, to prevent the deodorizer element 3 from escaping when the mat body 1 is moved in various directions.

Figure 7:
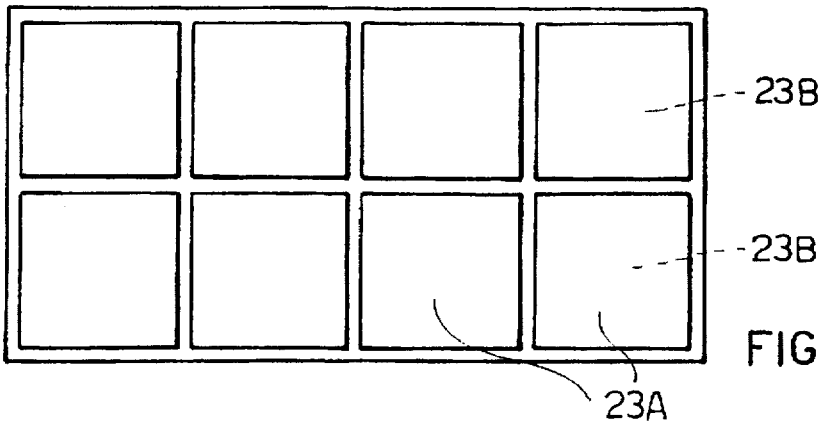
FIG. 7 is a plan view of a deodorizer element used in the bedding article of FIG. 5.

FIGS. 5–7 show another practical example of this invention. A mat 20 in this example comprises a number of pockets 22 consisting of cloth bags or pouches to store a deodorizer element 23, the pouches being provided along the width of the mat body 21. Openings are provided at both edges of each pouch, and the cloth 22A of the opening part is tucked into the pouch to prevent the deodorizer element 23 from escaping. When the deodorizer element 23 is to be removed from the pouch, the cloth 22A of the opening part of the above bag should first be taken out of the bag as the dotted line shows in FIG. 6.

As shown in FIGS. 6 and 7, the deodorizer element 23 to be stored inside the above-mentioned bags is composed of several sections (four in this example) of the deodorizer element as shown in FIG. 3, the pieces being arranged in a row.

Since the several pieces of deodorizer are linked together in this mat, the deodorizer element 23 can be efficiently removed and inserted in a short time.

Since the deodorizer element 23 is furnished with the mat body 21 as mentioned above, odors and moisture are sufficiently absorbed by the outstanding deodorant and hygroscopic properties of the active carbon 23B. As a result, the refreshing sensation provided by the mat body 21 lasts over a long period of time.

Furthermore, it enables the user to recover from fatigue because the unevenness of the mat body 21 caused by the presence of deodorizer elements 23 to stimulate acupuncture points of the user's body during use.

This also creates good ventilation of the mattress because it establishes a situation similar to one which the deodorizer would lie inside the mattress. Moreover, since the cloth of the opening part of the pocket is overlapped or tucked in towards the inside, there is no fear that the deodorizer can escape from the pocket whatever the direction of the mat during use. In addition, various benefits, such as recovering from fatigue during sleeping and so on, can be expected because the unevenness caused by the deodorizer stimulates acupuncture points of the user's back.

Figure 8:
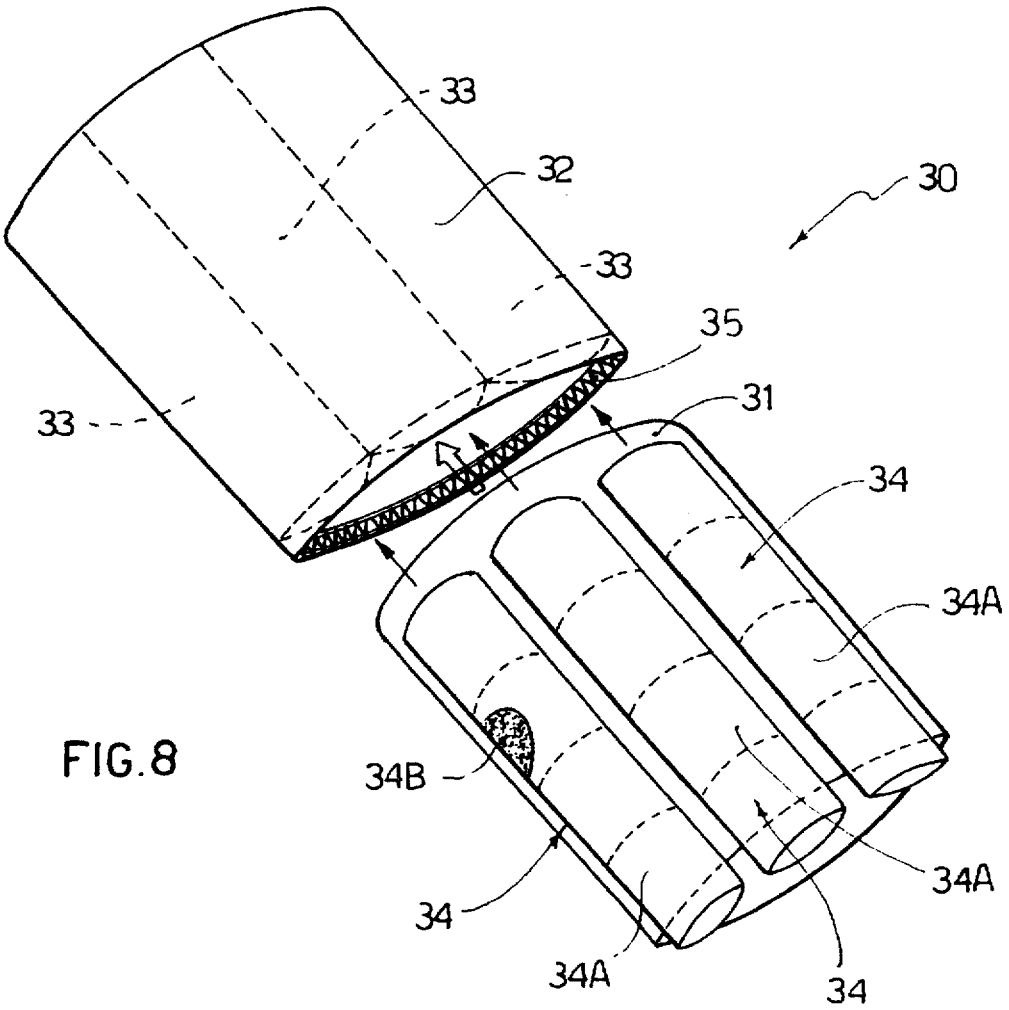
FIG. 8 shows a further embodiment of bedding article of the invention, in the form of a pillow, shown in an exploded partially cut-away perspective view.

In FIG. 8, 30 is a bedding article according to another preferred embodiment of the invention in the form of a pillow. 31 is a pillow stuffing core that is composed one or more of feathers, ester cotton, buckwheat husks, small polyester straws, and the like, that are inserted inside a cloth bag. The number of stuffing cores 31 is not limited to one. In fact, the pillow height can be freely regulated by adjusting the number of stuffing cores 31 inserted inside the pillow cover. In this case, the stuffing core material can be readily changed and a suitable combination of different materials for the stuffing core 31 can be used.

32 is a pillow cover made of cloth which covers the pillow stuffing core 31, and has an opening such that it can be freely opened and closed with a fastener 35. Pocket/pockets 33 is/are formed on at the upper side (the side on which the user's head is placed) or the lower side (the side which faces the mattress) of the pillow cover 32 or both (in this example, three pockets are provided on one side). A deodorizer element 34 is inserted inside each of the pockets 33 so that it can be easily inserted and removed.

The deodorizer element 34 preferably consists of a bag 34A made of a breathable non-fabric or paper fiber and active carbon granules 34B inserted into the bag 34A. Any other suitable material may be used instead of active carbon granules—such as charcoal granules and so on—as long as it has the desired deodorizing and hygroscopic properties. As shown in FIG. 1, bag 34A is preferably divided into a number of sections (four sections in this example) distributed along the length of the pillow to prevent the active carbon granules inside the bag 34A from being unevenly distributed.

Since active carbon granules 34B have excellent deodorizing and hygroscopic properties, odors and moisture are quickly and efficiently absorbed by them, which prevents the odors and moisture from being absorbed by the stuffing core 31. The active carbon granules 34B can be replaced with new ones when their deodorizing and hygroscopic properties decrease, because they can be easily inserted and removed from pocket 33. As a result, the refreshing sensation of the pillow lasts over a long period of time.

The deodorizer 34, apart from being inserted in the pocket of one of either sides of the pillow cover as mentioned above, can also be inserted into the pockets of both sides of the pillow cover 32.

As shown in pillow 40 of FIG. 9, pockets are preferably formed on both sides of pillow cover 42. The deodorizer, which is the same as above (not shown in the drawing), is placed inside a pocket (not shown in the drawing) on one side so that it can be easily inserted and removed, while Japanese cypress chips fill a mesh pocket on the other side. The chips release the fragrance of Japanese cypress throughout and favor restful sleep. The other elements and properties are the same as those mentioned previously.

As shown in FIGS. 10 and 11, a pillow 53 according to the invention comprises a stuffing core divided into two sections; an upper stuffing core layer 51A and a lower stuffing core layer 51B. The deodorizer 54 is inserted between the upper stuffing core layer 51A and lower stuffing core layer 51B. Both are covered by the cloth pillow cover 52 which has the shape of a bag. The pillow cover opening can be easily opened and closed by the fastener 57. Besides using the fastener 57, the pillow cover can be closed by prolonging the cloth 62B of one of the edges of a pillow cover 62 opening and folding this cloth 62B over the opposite side, as shown in FIGS. 12 and 13 for pillow 60. This feature can be utilized in obvious manner in the other embodiments in the same way whereby the deodorizer 54 is inserted into more than one pocket section (there are three sections in this example) that are formed by sewing together two pieces of cloth. The composition of the deodorizer is preferably the same as mentioned earlier.

In the pillow of FIGS. 10–11, the deodorizer 54 does not come into direct contact with the user's head as it does in the pillows of FIGS. 8 and 9. As a result, the user cannot feel the unpleasant bumpiness of the deodorizer granules 54B. The other effects are the same, i.e., a long-lasting, refreshing sensation due to the outstanding deodorizing and hygroscopic properties of the charcoal or active granules and to the Japanese cypress chips that are inserted in the pockets of the pillow, which create a certain useful effect because the pleasant fragrance of Japanese cypress is always released from the chips and favors restful sleep.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A bedding article, comprising:

a body provided with a plurality of pockets to each contain a deodorizer element; and deodorizer elements respectively contained in said pockets, wherein said body is made of cloth in the form of a mat, with several of said pockets provided on only one side thereof, and each pocket consists of a cloth pouch sewn to said one side of the mat and having a side opening to receive a deodorizer element, said pockets being arranged in a grid pattern, with the cloth at opposite sides of an opening part of each pouch overlapped so as to prevent escape of the deodorizer elements from corresponding opening parts.

2. The bedding article according to claim 1, wherein:

the deodorizer elements comprise respective breathable bags formed in sections containing respective amounts of a deodorizer material therein to ensure even distribution of the material in use.

3. The bedding article according to claim 2, wherein:

the breathable hags are made of paper.

4. The bedding article according to claim 2, wherein:

the breathable bags containing the deodorizer material are washable.

5. The bedding article according to claim 1, wherein:

the deodorizer elements comprise one of activated carbon granules and charcoal.

6. A bedding article, comprising:

a body provided with a plurality of pockets to each contain a deodorizer element; and deodorizer elements respectively contained in said pockets, wherein said body is made of cloth in the form of a mat, with several of said pockets provided on only one side thereof, and each of the pockets consists of a cloth pouch which has a side opening for receiving a corresponding deodorizer element and is sewn to said one side of the mat, wherein the pouches are arranged in a grid pattern, and the cloth of each pouch at a corresponding opening part thereof is tucked into the respective pouch so that the deodorizer element placed therein cannot escape.

7. The bedding article according to claim 6, wherein:

the deodorizer elements comprise respective breathable bags formed in sections containing respective amounts of deodorizer material therein to ensure even distribution of the material in use.

8. The bedding article according to claim 7, wherein:

the breathable bags are made of paper.

9. The bedding article according to claim 7, wherein:

the breathable bags containing the deodorizer material are washable.

10. The bedding article according to claim 6, wherein:

the deodorizer elements comprise one of activated carbon granules and charcoal.

11. A bedding article, comprising:

a body provided with a plurality of pockets to each contain a deodorizer element; and deodorizer elements respectively contained in said pockets, wherein said body is made of cloth in the form of a mat, with several of said pockets provided on only one side thereof, and each of the pockets consists of a cloth bag which has respective openings at two ends for receiving a corresponding deodorizer element at either end and the pockets are sewn to said one side of the mat, the pockets are arranged along a width of the mat, and the cloth of each opening part is tucked into the corresponding bag so that the corresponding deodorizer element placed therein cannot escape.

12. The bedding article according to claim 11, wherein:

the deodorizer elements comprise respective breathable bags formed in sections containing respective amounts of deodorizer material therein to ensure even distribution of the material in use.

13. The bedding article according to claim 12, wherein:

the breathable bags are made of paper.

14. The bedding article according to claim 12, wherein:

the breathable bags containing the deodorizer material are washable.

15. The bedding article according to claim 11, wherein:

the deodorizer elements comprise one of activated carbon granules and charcoal.

* * * * *